US009362679B2

(12) United States Patent
Schreier et al.

(10) Patent No.: US 9,362,679 B2
(45) Date of Patent: Jun. 7, 2016

(54) INSULATION BODY OF A PLUG-IN CONNECTOR

(71) Applicant: Harting Electronics GmbH, Espelkamp (DE)

(72) Inventors: Stephan Schreier, Rahden (DE); Melanie Genau, Luebbecke (DE)

(73) Assignee: HARTING ELECTRONICS GMBH, Espelkamp (DE)

( * ) Notice: Subject to any disclaimer, the term of this patent is extended or adjusted under 35 U.S.C. 154(b) by 0 days.

(21) Appl. No.: 14/406,608

(22) PCT Filed: Apr. 4, 2013

(86) PCT No.: PCT/DE2013/100120
§ 371 (c)(1),
(2) Date: Dec. 9, 2014

(87) PCT Pub. No.: WO2013/189479
PCT Pub. Date: Dec. 27, 2013

(65) Prior Publication Data

US 2015/0325956 A1 Nov. 12, 2015

(30) Foreign Application Priority Data

Jun. 18, 2012 (DE) ..... 10 2012 105 256

(51) Int. Cl.

| | |
|---|---|
| ***H01R 13/502*** | (2006.01) |
| ***H01R 13/6581*** | (2011.01) |
| ***H01R 13/03*** | (2006.01) |
| ***H01R 13/6471*** | (2011.01) |
| ***H01R 13/6584*** | (2011.01) |
| ***H01R 13/6599*** | (2011.01) |
| ***H01R 43/00*** | (2006.01) |
| *H01R 12/72* | (2011.01) |
| *H01R 13/506* | (2006.01) |

(52) U.S. Cl.
CPC ..... *H01R 13/6581* (2013.01); *H01R 13/035* (2013.01); *H01R 13/502* (2013.01); *H01R 13/6471* (2013.01); *H01R 13/6584* (2013.01); *H01R 13/6599* (2013.01); *H01R 43/007* (2013.01); *H01R 12/724* (2013.01); *H01R 13/506* (2013.01)

(58) Field of Classification Search
CPC ..... H01R 13/514; H01R 33/7642
USPC ..... 439/701, 79, 554, 557
See application file for complete search history.

(56) References Cited

U.S. PATENT DOCUMENTS

| | | | | |
|---|---|---|---|---|
| 5,199,896 A * | 4/1993 | Mosquera | ..... | H01R 12/714 29/842 |
| 6,129,586 A | 10/2000 | Bellemon | | |
| 6,200,146 B1 | 3/2001 | Sarkissian | | |

(Continued)

FOREIGN PATENT DOCUMENTS

| | | |
|---|---|---|
| DE | 9415357 | 1/1995 |
| DE | 202007006357 | 7/2007 |

(Continued)

*Primary Examiner* — Phuongchi T Nguyen
(74) *Attorney, Agent, or Firm* — Jacobson Holman, PLLC.

(57) ABSTRACT

The invention relates to an insulation body of a plug-in connector, which comprises connection elements (21) that can be electrically connected to conductor tracks of a circuit board and/or to individual wires of a multi-wired cable to be connected, wherein the connection elements (21) can be produced using MID technology.

10 Claims, 2 Drawing Sheets

(56) References Cited

U.S. PATENT DOCUMENTS

| | | | | |
|---|---|---|---|---|
| 7,144,260 | B2 * | 12/2006 | Murayama | H01R 23/688 439/108 |
| 7,318,757 | B1 * | 1/2008 | Minich | H01R 12/724 439/701 |
| 2002/0132502 | A1 * | 9/2002 | Gray | H01R 24/50 439/79 |
| 2004/0102060 | A1 | 5/2004 | Schauz et al. | |
| 2006/0246780 | A1 | 11/2006 | Bert et al. | |
| 2013/0137310 | A1 | 5/2013 | Genau | |
| 2014/0335717 | A1 | 11/2014 | Finzer | |

FOREIGN PATENT DOCUMENTS

| | | |
|---|---|---|
| DE | 102006041610 | 5/2008 |
| DE | 102009054611 | 6/2011 |
| DE | 102010051954 | 2/2012 |
| EP | 1909125 | 4/2008 |
| JP | 2000513137 | 10/2000 |
| JP | 2001266982 | 9/2001 |
| JP | 2008541354 | 11/2008 |
| JP | 2010091389 | 4/2010 |
| WO | WO 2012041310 | 4/2012 |

* cited by examiner

INSULATION BODY OF A PLUG-IN CONNECTOR

BACKGROUND AND SUMMARY OF THE INVENTION

The invention relates to an insulation body of a plug-in connector having connection elements for electrical connection to a circuit board or multi-wire cable.

An insulation body is inserted into a chamber of a plug-in connector housing that is provided for this purpose. As a rule, insulation bodies include receptacles for contact elements, which the wires of a cable that is to be connected to the plug-in connector are connected to. Alternatively, the contact elements may also be electrically contacted to the conductor tracks of a circuit board.

In data transmission technology, insulation bodies with so-called shielding elements are used. The shielding elements are used to shield at least two wires of the cable to be connected—and/or the associated contact elements—electromagnetically against each other.

DE 102010051954 B3 shows a circular plug-in connector, the contact elements of which penetrate the plug-in connector over its full length, in order to form on the one hand the plug face and on the other hand the connection region of the plug-in connector. The contact elements have to be embedded in the insulation body in such a way that they will not cause crosstalk at high data transmission rates. Such contact elements are frequently implemented with a bend, which makes the above task even more difficult.

It is the object of the invention to propose an insulation body that can be easily manufactured and yet has a good crosstalk behaviour.

In the insulation body, connection elements are provided. The connection elements have a connection region that can be electrically contacted for example by a conductor track of a circuit board.

According to the invention it is provided for the connection elements to be manufactured using MID (molded interconnect device) technology. As a result, there are no limits to the geometrical layout of the connection elements. Moreover, there is no longer a need to insert individual contacts, which in some circumstances are bent, into the insulation body, which reduces the number of components of a plug-in connector and simplifies the assembly thereof.

Advantageously, the connection elements are substantially implemented as conductor tracks. The conductor tracks substantially extend parallel to the lateral surface of the connection body and at least two conductor tracks are oriented in the direction of the central axis of the connection body to different depths. In this case, the conductor tracks continue to extend parallel to each other.

It may also be advantageous to allow the individual conductor tracks to submerge in the radial direction to the central axis of the connection body to different extents. In this case, the conductor tracks would no longer necessarily be oriented parallel to each other.

By means of the above measures, a plug-in connector having very good crosstalk properties can be produced. MID technology allows an altogether very flexible and accurate layout of the conductors to be achieved.

In an advantageous embodiment, the insulation body proposed here is implemented in multiple parts (for example in two parts). Advantageously, the insulation body proposed here consists of a plug body and a connection body. In the plug body, the contact elements are arranged that form the so-called plug face of the plug-in connector. In the connection body, connection elements are provided. The connection elements have a connection region that can be electrically contacted for example by a conductor track of a circuit board.

Preferably, the connection region is then formed as a so-called soldering foot 21*a* (also referred to as solder pin). However, here too, the SMD (surface mounted device) or pin-in-hole technology may be used. It is also possible to contact the connection region electrically with a wire of a cable to be connected.

In known insulation bodies, the plug body and the connection body are formed together in one component. In the case of the insulation body according to the invention, the plug body and the connection body are separate components. When these components are mated with each other, the contact elements of the plug body are electrically contacted with the connection elements of the connection body.

In order to allow the plug body and the connection body to be latched together, suitable latching means are provided. These latching means preferably allow a reversible connection of the plug body and the connection body.

By virtue of the plug body and the connection body being in two parts it becomes possible to reversibly connect the same plug body with different connection bodies. As a result, a plug-in connector having the same plug face can be conditioned on the one hand for a circuit board connection and on the other hand for a cable connection. The connection body can be optimally adapted to the respective area of use and can be implemented for example in an angled or in a straight manner. As a result of the modularity of the connection region as described above, the plug-in connector can be used in a versatile manner.

It may also be advantageous to design the plug body and the connection body so that they can be irreversibly latched together by means of latching means. This is advantageous in order to avoid multiple plugging and thus an increase of the transition resistance.

Preferably, the contact elements are formed to be elongate and are arranged parallel to each other in the plug body. One end of the contact member is provided in the plug region of the plug-in connector and can be connected to a contact element of a counter-plug and/or a socket. The other end of the contact element forms a contact region, which a connection element of the connection body can be electrically contacted with.

Preferably, the connection element is designed as a conductor track that forms a connection region for the contact elements thereof in the direction of the plug body. In the circuit board or cable connection direction, a connection region for a conductor track of a circuit board and/or a wire of a cable to be connected is located on the conductor track.

Advantageously, the conductor track of the connection member is produced using MID technology. MID technology is sufficiently described in DE 102006041610 B3. As a result, there is no limit to the freedom in designing the conductor tracks. The conductor tracks may be formed in such a way that they are particularly suitable for high frequency data transmission. The end-side connection regions following on from the conductor track (for example, on the one side a connection socket for the contact elements and on the other side the solder feet for the circuit board) may continue to be implemented as a metallic element.

In an advantageous embodiment of the invention, the plug body has a shielding element that shields at least two contact elements electromagnetically against each other. As a result, a so-called crosstalk of the signals that are transmitted via the contact elements is prevented.

In a further advantageous embodiment of the invention, the connection body is also provided with a shielding element that shields at least two connection elements electromagnetically against each other.

In a particularly preferred embodiment of the invention, the plug body and the connection body each have a shielding element. In the mated condition of the plug body and the connection body, the shielding elements are in electrical contact with each other. Alternatively, the shielding elements overlap in an axial orientation of the insulation body. As a result of the above measures, the signal integrity of the finished plug-in connector is markedly improved.

Advantageously, the above-described shielding elements are produced using MID technology. As a result, the plug body and the connection body may be produced in one piece in a compact and cost-effective manner.

BRIEF DESCRIPTION OF THE DRAWINGS

An embodiment example of the invention is shown in the drawings and will be explained in more detail below, wherein.

DETAILED DESCRIPTION OF THE INVENTION

Figure 1:
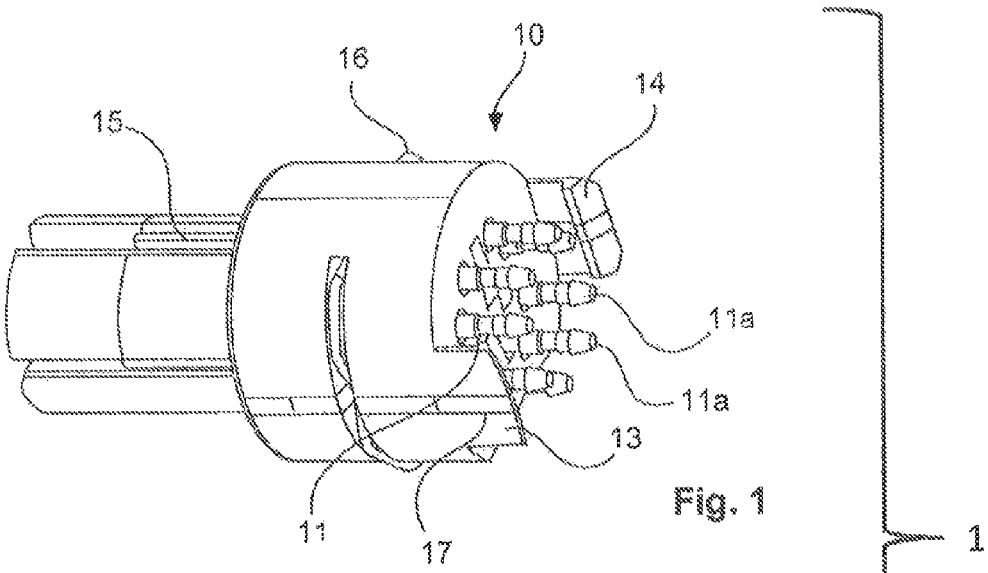
FIG. 1 shows a perspective view of a plug body.
Figure 2:
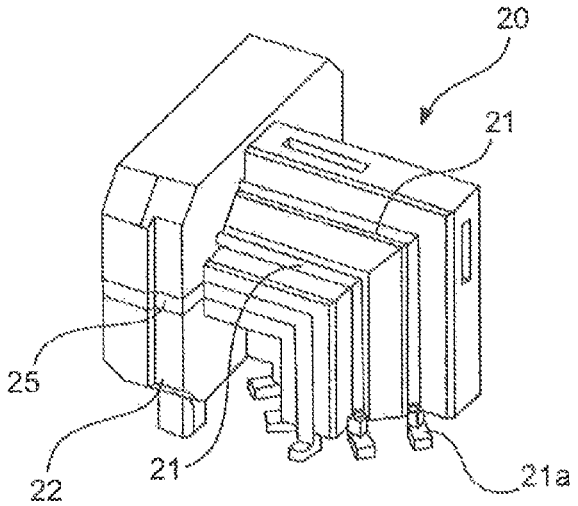
FIG. 2 shows a perspective view of a connection body.
Figure 3:
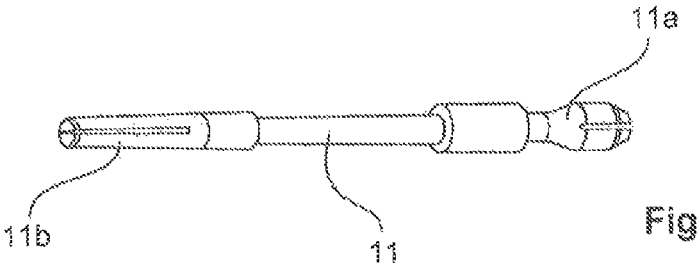
FIG. 3 shows a perspective view of a contact element.
Figure 4:
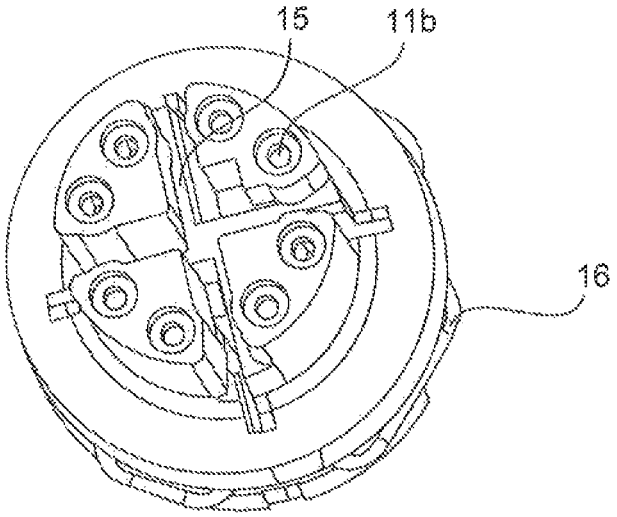
FIG. 4 shows a perspective top view of the plug face of the plug body.
Figure 5:
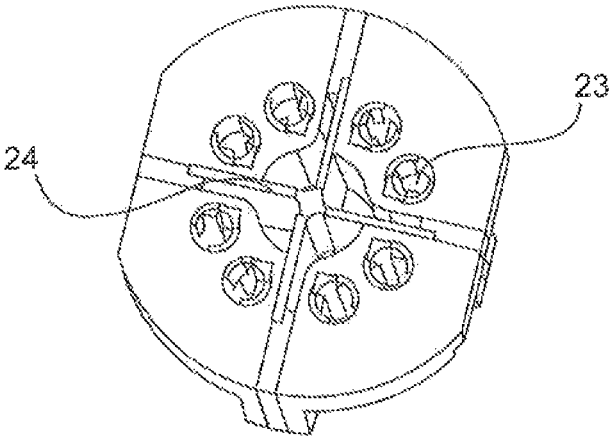
FIG. 5 shows a further perspective view of the connection body.

FIG. 1 shows a perspective view of a plug body 10 and FIG. 2 shows a perspective view of the associated connection body 20. The plug body 10 and the connection body 20 together form an insulation body 1 for a plug-in connector. In order to lock the plug body 10 and the connection body 20 together, latching arms 13 are provided on the plug body 10, the latching noses 14 of which latching arms engage on an undercut 22 of the connection body 20.

In the plug body 10, contact elements 11 are provided. One end of the contact element 11 can be electrically contacted with the associated connection elements 21 of the connection body 20. To this end, the frustoconical portion 11*a* is inserted into a contact opening 23 of the connection body 20. The contact opening 23 comprises a conducting material, which in turn is conductively connected to a conductor track 21. The other end is implemented as a bifurcated contact terminal 11*b* and is provided for contacting contact elements of a counterplug and/or a socket (not shown). In other embodiments, a simple contact pin instead of the bifurcated contact terminal may be provided in the plug face.

In the plug body 10, a cruciform shielding element 15 is provided, which electromagnetically shields in each case two contact elements 11*b* in a pairwise manner relative to the other contact elements 11*b* arranged in a pairwise manner. A metallic shielding spring 16 is in conductive contact with the shielding element 15 and the plug-in connector housing (not shown).

In the connection body 20, too, a cruciform shielding element 24 is provided, which in each case shields two connection elements 21 in a pairwise manner electromagnetically against other connection element pairs.

A conductor track 17, which is connected to the shielding element 15 in a conductive manner, is attached to the latching arm 13 of the plug body 10. Also in the region of the undercut 22 of the connection body 20, a conductor track 25 is applied, which is connected to the shielding element 24. Via the conductor tracks 17, 25, the shielding elements 15, 24 are also contacted in a conductive manner. The conductor tracks 17, 25 are here produced using MID technology.

LIST OF REFERENCE NUMERALS

1 Insulation body
10 Plug body
Contact element
11*a* Frustoconical portion
11*b* Bifurcated contact terminal
13 Latching arm
14 Latching nose
15 Shielding element
16 Shielding spring
17 Conductor track
20 Connection body
21 Connection element
22 Undercut
23 Contact opening
24 Shielding element
25 Conductor track

The invention claimed is:

1. An insulation body of a plug-in connector, said insulation body formed from at least two parts comprising a plug body (10) having contact elements (11) arranged therewithin, and a connection body (20) defining a central axis and having lateral surfaces and that includes connection elements (21) that electrically connect the contact elements of the plug body with an external connection region that includes conductor tracks of a circuit board and/or to individual wires of a multi-wired cable when the plug body (10) is connected to the connection body (20), wherein said connection elements (21) are produced using MID technology whereby said connection elements (21) define electrically conductive tracks that extend substantially parallel to said lateral surfaces of the connection body (20) and are oriented in the direction of the central axis of the connection body (20) at different depths from the lateral surfaces.

2. The insulation body of a plug-in connector as claimed in claim 1, characterised in that the plug body (10) and the connection body (20) can be reversibly latched together by means of latching means (13, 14, 22).

3. The insulation body of a plug-in connector as claimed in claim 1, characterised in that the plug body (10) and the connection body (20) can be irreversibly latched together by means of latching means (13, 14, 22).

4. The insulation body of a plug-in connector as claimed claim 1, characterised in that the connection elements (21) can be partially realised using MID technology.

5. The insulation body of a plug-in connector as claimed in claim 1, characterised in that the connection body (20) has an angled shape.

6. The insulation body of a plug-in connector as claimed in claim 1, characterised in that the connection body (20) has a straight shape.

7. The insulation body of a plug-in connector as claimed in claim 1, characterised in that the plug body (10) includes a shielding element (15) that electromagnetically shields at least two contact elements (11) against each other.

8. The insulation body of a plug-in connector as claimed in claim 7, characterised in that the shielding elements (15, 24) are electrically contacted with each other and/or overlap in the axial direction.

9. The insulation body of a plug-in connector as claimed in claim 7, characterised in that the connection body (20)

includes a shielding element (24) that electromagnetically shields at least two connection elements (21) against each other.

10. The insulation body of a plug-in connector as claimed in claim 9, characterised in that the shielding elements (15, 24) are produced using MID technology.

* * * * *